US005833242A

United States Patent [19]

Watkins

[11] Patent Number: 5,833,242

[45] Date of Patent: Nov. 10, 1998

[54] TARGETING GAME

[76] Inventor: James V. Watkins, 513 23rd St., Cairo, Ill. 62914

[21] Appl. No.: 378,472

[22] Filed: Jan. 26, 1995

[51] Int. Cl.[6] ..... A63F 7/02

[52] U.S. Cl. ..... 273/351; 273/317; 273/445

[58] Field of Search ..... 273/351, 408, 273/404, 1.5 R, 445, 357, 446, 352, 355, 356, 120 R, 129 Q, 317

[56] References Cited

U.S. PATENT DOCUMENTS

| | | | |
|---|---|---|---|
| 271,530 | 1/1883 | Spang . | |
| 2,127,276 | 8/1938 | Tratsch | 273/357 |
| 2,339,209 | 1/1944 | Vensel | 273/351 |
| 2,452,817 | 11/1948 | Whipple et al. | 273/351 |
| 2,454,478 | 11/1948 | Roberts | 273/445 |
| 2,791,427 | 5/1957 | Johnson | 273/351 |
| 3,083,019 | 3/1963 | Giuliano . | |
| 3,208,751 | 9/1965 | Kostka | 273/351 |
| 3,488,052 | 1/1970 | Weisbecker | 273/1 |
| 3,567,221 | 3/1971 | Stults | 273/1 |
| 4,036,497 | 7/1977 | Garto et al. | 273/357 |
| 4,120,497 | 10/1978 | Goldfarb et al. | 273/95 B |
| 4,126,309 | 11/1978 | Hicks | 273/351 |
| 4,133,526 | 1/1979 | Anson | 273/1 R |
| 4,240,628 | 12/1980 | Brownfield | 273/1 R |
| 5,125,651 | 6/1992 | Keeling et al. | 273/1.5 R |
| 5,240,260 | 8/1993 | Strongin | 273/445 |

FOREIGN PATENT DOCUMENTS

| | | |
|---|---|---|
| 74168 | 4/1952 | Denmark . |
| 2607020 | 11/1986 | France . |
| 168175 | 3/1934 | Switzerland . |

*Primary Examiner*—Mark S. Graham

*Attorney, Agent, or Firm*—Senniger, Powers Leavitt & Roedel

[57] ABSTRACT

A method for playing a targeting game including launching aimed objects toward targeted receptacles until aimed objects are deposited in all targeted receptacles except a home receptacle. The player who deposits aimed objects into all of his targeted receptacles and further deposits and aimed object in the home receptacle wins the game or round depending on the format of play. Targeting game apparatus includes a target base containing holes which are the targeted receptacles and a target line panel spaced vertically above the base from which the aimed objects are aimed and dropped.

16 Claims, 3 Drawing Sheets

TARGETING GAME

BACKGROUND OF THE INVENTION

This invention relates to games in which players attempt to hit designated targets, and more specifically to a game in which preliminary targets are hit leading up to a final target.

Presently existing targeting games involve competition between players who alternate throughout the game in attempting to hit one or more designated targets. In that regard, the competition is highly indirect in that players attempt to hit different targets (or the same target at different times) and winners are, typically, determined by the number of targets hit. Thus, while skill at hitting the target is important, the players do not challenge one another with regard to the speed at which targets are hit.

Thus, there is presently a need for a game in which players are placed directly in competition with one another to race in hitting targets leading up to a common finishing target.

SUMMARY OF THE INVENTION

Among the several objects of this invention may be noted the provision of a method for playing a targeting game in which players race to reach a common finishing target; the provision of such a game which requires skill and manual dexterity to hit the target; the provision of such a game which is entertaining and challenging to play.

Further among the several objects and features of the present invention may be noted the provision of targeting game apparatus which is compactly stored; the provision of such apparatus which captures objects aimed at, but missing the target; the provision of such a game which is inexpensive to manufacture.

Generally, a method for playing a targeting game of the present invention includes the step of providing target means comprising targeted receptacles including a home receptacle. The targeted receptacles are arranged in at least two groups extending away from the home receptacle. Aimed objects provided for launching toward the targeted receptacles are sized and shaped for reception in one of the targeted receptacles. Targeting line means spaced from said target means defines a minimum distance from said target means at which the aimed objects may be aimed and launched in an attempt to deposit the aimed objects into the targeted receptacles. The method requires that the following two steps be carried out, in order, by at least two players: (a) launching one of the aimed objects toward the targeted receptacles in a respective one of the groups of targeted receptacles until all targeted receptacles in that group have aimed objects deposited therein; and (b) launching one of the aimed objects toward the home receptacle until one of the aimed objects is deposited in the home receptacle.

Generally, targeting game apparatus of the present invention includes target means comprising targeted receptacles, aimed objects and targeting line means as provided above. Moreover, there is a frame for supporting the targeting line means at a location spaced from said target means.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figures 1, 2, 3, 4, 5:
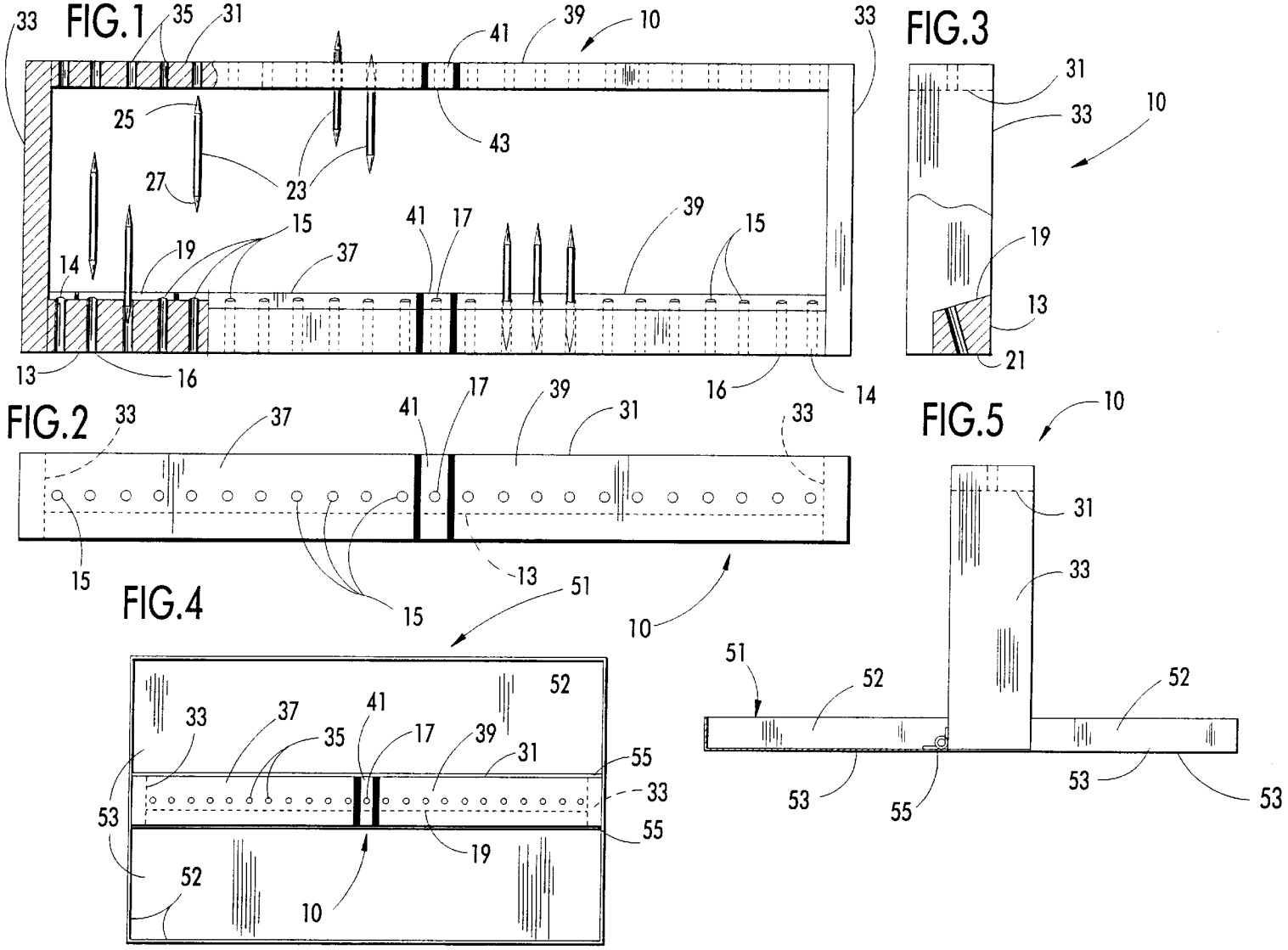
FIG. 1 is a front elevation showing targeting game apparatus of this invention in partial section to reveal details of targeting holes and aiming holes.
FIG. 2 is a top plan of the game of FIG. 1.
FIG. 3 is a side elevation of the game of FIG. 1 with parts broken away to show details of a target of the apparatus.
FIG. 4 is a top plan of the game of FIG. 1 installed in a folding tray.
FIG. 5 is a side elevation of the game and tray of FIG. 4 shown in partial section to reveal a hinge.
Figure 6:
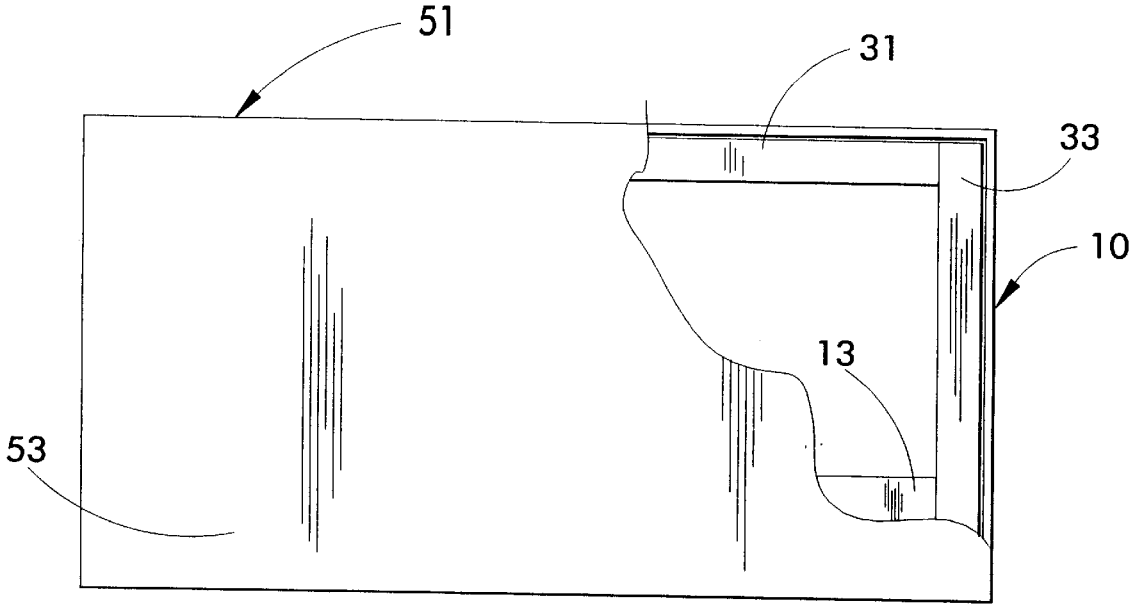
FIG. 6 is a front elevation of the tray of FIG. 4 in a folded position.

Referring now to the drawings, and first to FIG. 1, there is generally indicated at 10 a targeting game comprising a base 13 having targeted holes 15, including a home hole 17, in its upper surface 19. As shown in FIG. 3, the upper surface 19 of the base 13 is sloped with respect to the horizontal and nonparallel with a bottom surface 21 of the base on which the base rests. In the preferred embodiment, the base 13 constitutes "target means" and the holes 15 in the base constitute "targeted receptacles". As shown in FIG. 2, the targeted holes 15 are arranged one after another in two groups along at least two separate paths beginning at respective locations remote from the home hole and extending to the home hole 17. It is to be understood that two or more groups of targeted holes (not shown) may be arranged other than as described and still fall within the scope of the present invention. Moreover, targeted receptacles need not be holes formed in a unitary body (i.e., the base 13) to fall within the scope of the present invention. It is envisioned, for example, that the targeted receptacles could be individual cups.

Aimed objects, in the form of pegs 23, are sized and shaped for reception in one of the targeted holes 15. As shown in FIG. 1, the pegs 23 are generally cylindrical and have first 25 and second 27 opposite ends which are tapered. The pegs preferably have one of two colors to distinguish the pegs to be used by a first player from those to be used by a second player. The pegs 23 may be made from wood, metal, plastic or other suitable material.

As explained more fully below, the pegs 23 are dropped toward the target base 13 from a targeting line panel 31 supported above the base by a pair of stanchions 33 (broadly, "frame") located at longitudinally opposite ends of the base. The targeting line panel 31 has one aiming opening 35 in it for each targeted hole 15 in the base. Each aiming opening 35 is generally vertically aligned with a corresponding one of the targeted holes 15, and sufficiently large to permit passage of one of the pegs 23. The targeting line panel 31 defines a minimum distance from the base 13 at which the pegs 23 may be aimed and launched in an attempt to deposit the pegs into the targeted holes 15.

Referring to FIG. 1, the game apparatus 10 is preferably divided into left, right and middle sections (designated by reference numerals 37, 39 and 41, respectively) which may be differentiated by color (not shown). In the drawings, the sections are demarcated only by the heavy black lines on either side of the home hole 17. The portions of the base 13 and targeting line panel 31 around the home hole 17 and aiming opening 43 above the home hole form the middle section, and may have a first color (e.g., black). The portion of the game apparatus to the left of the middle section may have a second color (e.g., red), and the portion of the game apparatus to the right of the middle section may have a third color (e.g., blue). The color designations, as explained below, designate the home hole 17 and the targeted holes 15 belonging to a "red" player and a "blue" player.

Referring now to FIGS. 4–9, the game apparatus is shown to further include a tray, generally indicated at 51, located generally around the base 13 for capturing pegs 23 launched from the targeting line panel 31 which miss their corresponding targeted holes 15 and ricochet away from the base. In that regard, the peripheral edge margins of the tray 51 are upturned to form retaining walls 52 to hold the errant pegs 23 within the tray. The stanchions 33 are constructed to prevent the pegs 23 from bouncing away from the base 13 at the ends of the base. In a first preferred embodiment shown in FIGS. 4–6, the tray 51 comprises tray members 53 located on opposite sides of the base and attached to the base by hinges 55. In the illustrated embodiment, the hinges 55 extend along the length of the base 13 which is permanently attached to the tray 51. The hinged connection of the tray members 53 permits them to move between a use position (FIGS. 4 and 5) in which the tray member 53 extends laterally outwardly from the base 13, targeting line panel 31 and stanchions 33, and a storage position (FIG. 6) in which the tray member 53 is disposed generally closely adjacent to the base, the targeting line panel and the stanchions. The tray members 53 are each sized to accommodate the height of the stanchions 33 so that the base 13 targeting line panel 31 and stanchions 33 are completely enclosed by the tray 51 in the storage position. There is plenty of room within the enclosure formed by the folded tray members 53 to store the pegs 23. A handle, not shown, may be mounted on the tray members 53 to facilitate carrying the game. Thus, the targeting game apparatus 10 of the present invention may be compactly stored when not in use.

Figure 8:
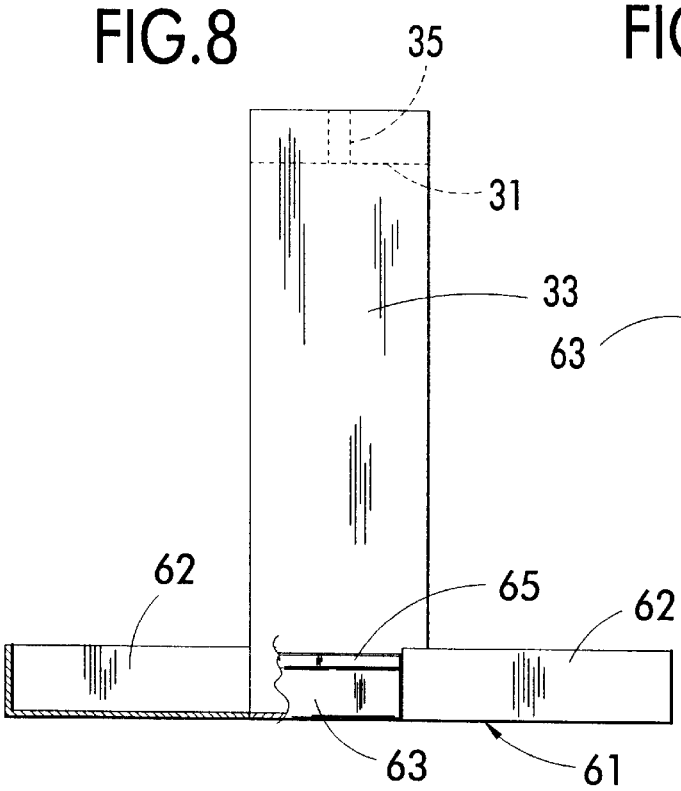
FIG. 8 is a side elevation of the game and tray of FIG. 7.
Figure 9:
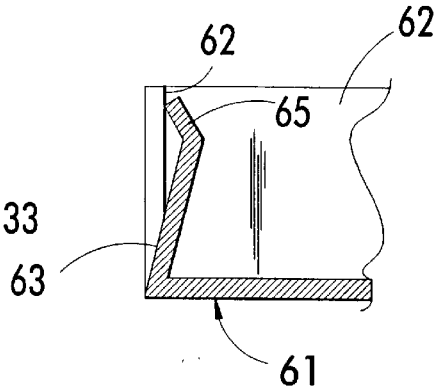
FIG. 9 is an enlarged, fragmentary section of the tray of FIG. 7 showing a spring member for releasably attaching the tray to the game.
Figure 7:
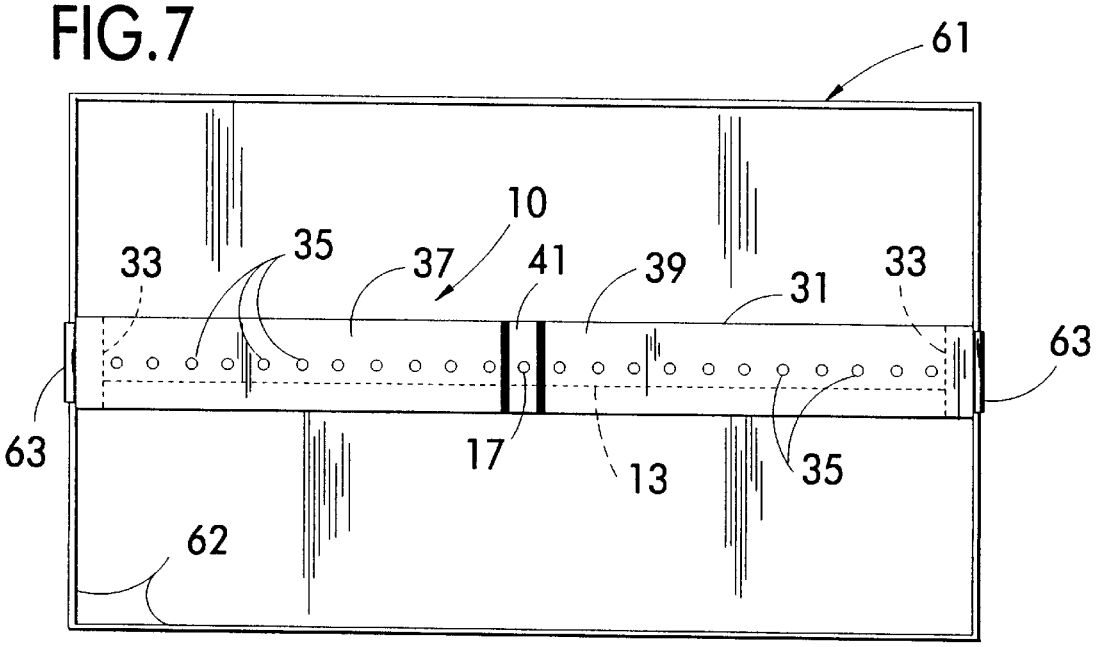
FIG. 7 is a top plan of the game of FIG. 1 installed in a releasably attachable tray.

In an alternate embodiment shown in FIGS. 7–9, a tray generally indicated at 61, comprises a retaining wall 62 including spring members 63 for releasably attaching the tray to the targeting game apparatus. The spring members 63 are mounted on the tray 61 and disposed for gripping respective stanchions 33 to hold the tray onto the game apparatus 10 (FIG. 9). The spring members 63 comprise a portion of the tray 61 which is cut out and bent to extend inward into the tray. The return bend 65 at the upper end of each spring member 63 defines a flared end which is engageable with a respective stanchion 33 to facilitate mounting the tray 61 on the game apparatus 10. To set up the game 10 for play, the game apparatus is moved down into the tray 61 with the stanchions 33 engaging respective spring members 63 and deflecting the spring members outwardly from their rest positions. The spring members 63 are constructed from an elastic material so that when each spring member is deflected from its rest position, the spring member bears against the stanchion 33 and holds the tray 61 on the stanchions. The stanchions 33 may be formed with a recess (not shown) for receiving portions of the spring members 63. The tray 61 may be removed by pulling the game apparatus 10 with sufficient force to overcome the holding force of the spring members 63. The tray 61 is sized according to the height of the game apparatus 10 so that the game apparatus can be stored compactly in a flat position within the boundaries of the tray 61.

A preferred method for playing the targeting game 10 of the present invention begins with selecting a respective one of second and third colors for each of two players (e.g., a "red" player and a "blue" player). The pegs 23 having the color corresponding to each player are collected by that player before the competition is underway. Beginning at the same time, the players launch pegs 23 from the targeting line panel 31 toward respective targeted holes 15 away from the home hole 17. The "red" player would, for instance, drop a peg 23 through an aiming opening 35 in the red portion of the targeting panel 31 toward the underlying targeted hole 15 in the red portion of the base 13. Each player continues to drop pegs 23 through the aimed opening 35 as many times as necessary until one of the pegs is deposited in the targeted hole 15. The slope of the upper surface of the base 13 is designed to increase the difficulty of hitting the targeted hole 15.

The competition continues in this manner until a first of the players has deposited a peg 23 in each one of the targeted holes 15 of the group in his respective section (e.g., left section 37). At that time the first player may begin to drop pegs 23 toward the home hole 17 from the aiming opening 43 directly above it. The first player may drop as many pegs 23 as he can in an effort to deposit one in the home opening 17 while the second player races to finish depositing pegs in the group of targeted holes 15 in his section (e.g. right section 39). If the first player is successful in depositing a peg 23 in the home hole 17, the game or round is over. However, if the second player successfully deposits his pegs 23 in all of the targeted holes 15 in his own section 39 before the first player deposits one of his pegs in the home receptacle 17, the players then alternate turns at dropping one of their pegs toward the home hole. Again, the player who deposits one of his own pegs 23 into the home hole 17 first, is the winner.

It is to be understood that the game has several preferred variations of competition. In one form, at the conclusion of each round of the game (i.e., when one player deposits a peg 23 in the home hole 17) players are awarded points based on the number of targeted holes 15 in which they have successfully deposited pegs. The winner of the round will be allotted a greater number of points for also having deposited one of his pegs in the home hole 17. The players can play a set number of rounds or until one player has accumulated a predetermined point total.

The players may be permitted to target the targeted holes 15 in their respective sections randomly, proceeding from hole to hole as they choose, whether or not they have successfully deposited a peg 23 in the prior hole targeted. However, the players may alternatively be required to hit the targeted holes 15 in a predetermined order. For example, the players may begin at the targeted hole 15 most remote from the home hole 17 (designated by reference numeral 14), and proceed to the next adjacent one of the targeted holes 15 (designated by reference numeral 16) only when the player has successfully deposited a peg 23 in the first targeted hole 14. In this variation the players proceed along a path toward the home hole 17, advancing only when a peg 23 is successfully deposited in the immediately prior targeted hole 15. Of course, it is envisioned that there could be other required orders in which the pegs 23 must be deposited in the targeted holes 15.

In still another variation of the game, one or more players race against a clock (not shown) and each other to deposit as many pegs 23 in targeted holes 15 as possible in a set period of time. Points are awarded to each player based on the number of pegs 23 successfully deposited within the time period.

It is envisioned that the unique method of the present invention may be carried out without the game apparatus 10 described above. More specifically, it is believed that the game could be carried out using a microprocessor device. In that event, the target base 13, the pegs 23 and the targeting line panel 31 would be represented visually on a monitor without physical embodiment. In other words, while these features would still be "provided" their provision would be electronic rather than in the form of mechanical structure. The steps could be carried out by operation of microprocessor input mechanisms and software of the kind well known to those of ordinary skill in the art.

In view of the above, it will be seen that the several objects of the invention are achieved and other advantageous results attained.

As various changes could be made in the above constructions without departing from the scope of the invention, it is intended that all matter contained in the above description and shown in the accompanying drawings shall be interpreted as illustrative and not in a limiting sense.

What is claimed is:

1. A method for playing a targeting game comprising the steps of:

providing target means comprising targeted receptacles including a common home receptacle, the targeted receptacles being arranged in at least two groups extending away from the home receptacle;

providing aimed objects, each aimed object being sized and shaped for reception in one of the targeted receptacles;

providing targeting line means spaced from said target means for defining a minimum distance from said target means at which the aimed objects may be aimed and launched in an attempt to deposit the aimed objects into the targeted receptacles;

and further comprising the following steps, carried out in competition by at least two players;

one player launching the aimed objects one at a time toward the targeted receptacles in the first group of targeted receptacles until all targeted receptacles in that group have aimed objects deposited therein, and the other slayer substantially simultaneously launching the aimed objects one at a time toward the targeted receptacles in the second group of targeted receptacles until all targeted receptacles in that group have aimed objects deposited therein; and at least one of the players who has previously deposited aimed objects in all of the receptacles in a respective one of the groups launching the aimed objects one at a time toward the common home receptacle until one of the aimed objects is deposited in the home receptacle, the first player to deposit one of the aimed objects in the home receptacle winning the game.

2. A method as set forth in claim 1 wherein the step of launching the aimed objects toward the home receptacle comprises the step of alternating launches of aimed objects between the two players when both players have deposited aimed objects of the targeted receptacles in their respective groups.

3. A method as set forth in claim 2 wherein the steps of launching the aimed objects toward targeted receptacles comprises the step of dropping one of the aimed objects toward the targeted receptacles.

4. A method as set forth in claim 3 further comprising the step of providing tray means adjacent to said target means for catching launched aimed objects which miss targeted receptacles toward which they are dropped.

5. A method as set forth in claim 4 wherein the step of providing said target line means comprises the step of providing a targeting line panel supported in a position spaced generally vertically above said target means, the targeting line panel having one opening for each receptacle of said target means, each of the openings in the targeting panel being generally aligned with a corresponding one of the targeted receptacles.

6. A method as set forth in claim 1 wherein the steps of launching the aimed objects toward the targeted receptacles comprises the steps of dropping the aimed objects toward the targeted receptacles.

7. A method as set forth in claim 1 wherein each of the steps of launching the aimed objects toward the targeted receptacles in a respective one of the groups of targeted receptacles comprises the steps, in order, of:

launching the aimed objects generally from said target line means toward a first one of the targeted receptacles in said one group as many times as necessary until one of the aimed objects is deposited in the first targeted receptacle;

launching the aimed objects generally from said target line means toward a second one of the targeted receptacles in said one group as many times as necessary until one of the aimed objects is deposited in the second targeted receptacle;

successively launching the aimed objects from said targeting line means toward subsequent ones of the targeted receptacles in said one group until all targeted receptacles in the group have aimed objects deposited therein, said step of successively launching including the step of proceeding to launch aimed objects toward a subsequent one of the targeted receptacles only when an aimed object is deposited in an immediately prior one of the targeted receptacles.

8. A method as set forth in claim 1 further comprising the step of terminating the steps of launching the aimed objects toward the targeted receptacles and the steps of launching the aimed objects toward the home receptacle upon passage of a set period of time from the initiation of said launching steps.

9. A method for playing a targeting game comprising the steps of:

providing target means comprising targeted receptacles including a home receptacle;

providing aimed objects, each aimed object being sized and shaped for reception in one of the targeted receptacles;

providing a targeting line panel spaced from said target means for defining a minimum distance from said target means at which the aimed objects may be aimed and launched in an attempt to deposit the aimed objects into the targeted receptacles; said targeting line panel being supported in a position spaced generally vertically above said target means, the targeting line panel having one opening for each receptacle of said target means, each of the openings in the targeting panel being generally aligned with a corresponding one of the targeted receptacles;

and further comprising the following steps in order; launching the aimed objects one at a time toward the targeted receptacles until all targeted receptacles have aimed objects deposited therein; and launching one of the aimed objects toward the home receptacle until one of the aimed objects is deposited in the home receptacle.

10. A method as set forth in claim 9 wherein the step of launching the aimed objects toward targeted receptacles comprises the step of dropping the aimed objects toward the targeted receptacles.

11. A method as set forth in claim 10 further comprising the step of providing tray means adjacent to said target means for catching launched aimed objects which miss targeted receptacles toward which they are dropped.

12. A method as set forth in claim 9 wherein the step of launching the aimed objects toward the targeted receptacles comprises the steps, in order, of:

launching the aimed objects generally from said target line panel toward a first one of the targeted receptacles as many times as necessary until one of the aimed objects is deposited in the first targeted receptacle;

launching the aimed objects generally from said target line panel toward a second one of the targeted receptacles as many times as necessary until one of the aimed objects is deposited in the second targeted receptacle;

successively launching the aimed objects from said targeting line panel toward subsequent ones of the targeted receptacles until all targeted receptacles in the group have aimed objects deposited therein, said step of successively launching including the step of proceeding to launch aimed objects toward a subsequent one of the targeted receptacles only when an aimed object is deposited in an immediately prior one of the targeted receptacles.

13. A method as set forth in claim 9 further comprising the step of terminating the steps of launching the aimed objects toward the targeted receptacles and the step of launching the aimed objects toward the home receptacle upon passage of a set period of time from the initiation of said launching steps.

14. A method as set forth in claim 9 wherein the step of providing target means includes the provision of two groups of the targeted receptacles extending away from the home receptacle, and wherein the step of launching aimed objects toward the targeted and home receptacles are carried out in competition by at least two players, and further wherein the step of launching aimed objects includes one player launching the aimed objects one at a time toward the targeted receptacles in the first group of targeted receptacles until all targeted receptacles in that group have aimed objects deposited therein, and the other player substantially simultaneously launching the aimed objects one at a time toward the targeted receptacles in the second group of targeted receptacles until all targeted receptacles in that group have aimed objects deposited therein, and at least one of the players who has previously deposited aimed objects in all of the receptacles in a respective one of the groups launching the aimed objects one at a time toward the home receptacle until one of the aimed objects is deposited in the home receptacle, the first player to deposit one of the aimed objects in the home receptacle winning the game.

15. A method as set forth in claim 14 wherein the step of launching the aimed objects toward the home receptacle comprises the step of alternating launches of aimed objects between two players when both players have deposited aimed objects in the targeted receptacles of their respective groups.

16. A method as set forth in claim 14 wherein the step of launching the aimed objects toward the targeted receptacles comprises the steps of dropping the aimed objects toward the targeted receptacles.

* * * * *